United States Patent [19]

Strahle

[11] Patent Number: 4,662,298

[45] Date of Patent: May 5, 1987

[54] HANDICAP TRAP SEAT

[76] Inventor: Michael R. Strahle, 6958 Riverside Dr., Redding, Calif. 96001

[21] Appl. No.: 839,165

[22] Filed: Mar. 13, 1986

[51] Int. Cl.[4] ..... B63B 1/12

[52] U.S. Cl. ..... 114/61; 114/363; 297/464

[58] Field of Search ..... 114/39.1, 61, 363; 441/129–132; 297/445, 452, 464

[56] References Cited

U.S. PATENT DOCUMENTS

| | | | |
|---|---|---|---|
| 645,745 | 3/1900 | Gibson et al. | 182/58 |
| 1,989,872 | 2/1935 | Mancuso | 304/27 |
| 3,862,456 | 1/1975 | Fisher et al. | 114/39 |
| 4,030,436 | 6/1977 | Stoberl | 114/39 |
| 4,442,787 | 4/1984 | Curran et al. | 114/363 |
| 4,469,377 | 9/1984 | O'Rourke | 297/464 |
| 4,496,325 | 1/1985 | Tweg | 114/61 |
| 4,537,446 | 8/1985 | Roney et al. | 297/464 |

FOREIGN PATENT DOCUMENTS

| | | | |
|---|---|---|---|
| 184093 | 10/1984 | Japan | 114/39 |

OTHER PUBLICATIONS

Hobie Cat 14, Hobie Cat, Oceanside, Calif. copyright 1981.

*Primary Examiner*—Joseph F. Peters, Jr.
*Assistant Examiner*—Stephen P. Avila
*Attorney, Agent, or Firm*—Leonard D. Schappert

[57] ABSTRACT

A handicap trap seat for use with catamarans or other sailboats utilizing pontoons and a support frame extending therebetween which minimizes the likelihood of the user's being injured or sliding out of the trap seat while sailing.

4 Claims, 4 Drawing Figures

HANDICAP TRAP SEAT

BACKGROUND OF THE INVENTION

1. Field of the Invention

This invention relates generally to boats; more specifically to devices known as trap seats, and particularly to trap seats designed to support handicapped individuals when sailing a catamaran or other sailboat.

2. Description of the Prior Art

Sailboats, particularly small sailboats, and specifically small catamarans, are often sailed at an angle to the wind which creates stresses on the boat structure and tilts the structure somewhat. In order to enable individuals to adjust the weight distribution of the sailboat, trap seats have been utilized which extend up and over the side of the sailboat, and which allow an individual to achieve considerable stability even when the boat is listing sharply. However, such trap seats have been designed with individuals in mind who are unfettered by handicaps. Thus, handicapped persons have not been provided with the means necessary to sail comfortably and safely. The present invention is directed toward such a trap seat for use by handicapped persons. None of the prior art of which the applicant is aware has taught a trap seat designed to accomplish this purpose or, indeed, capable of accomplishing this purpose.

SUMMARY OF THE INVENTION

The present invention consists of a trap seat for use with small catamarans and other sailboats which is particularly adapted to use by quadriplegics and/or paraplegics and other handicapped persons who have limited use of their arms or legs. The device consists of a seat frame including back and side supports, with a flexible slung seat extending between the back support and to or near the point at which the trap seat attaches to the sailboat. A slung seat arrangement is utilized to ensure that the trap seat conforms to the contour of the body of the person using it, and the end supports are utilized to ensure that the person is protected from sliding out of the seat.

The primary object of the present invention is to provide a trap seat for use with small sailboats and catamarans which includes features that make it both comfortable and safe for handicapped persons to sail sitting in the position afforded by the trap seat.

Another object of the present invention is to provide a trap seat which includes features that allow the seat to conform to the body contours of the person using it, thereby increasing comfort immeasurably.

A further object of the present invention is to provide a trap seat which, due to its structure, not only increases the comfort of a persons sitting in it, but virtually eliminates the likelihood of an individual falling out of the trap seat.

The foregoing objects, as well as other objects and benefits of the present invention, are made more apparent by the description and claims which follow.

DESCRIPTION OF THE PREFERRED EMBODIMENT

Figure 1:
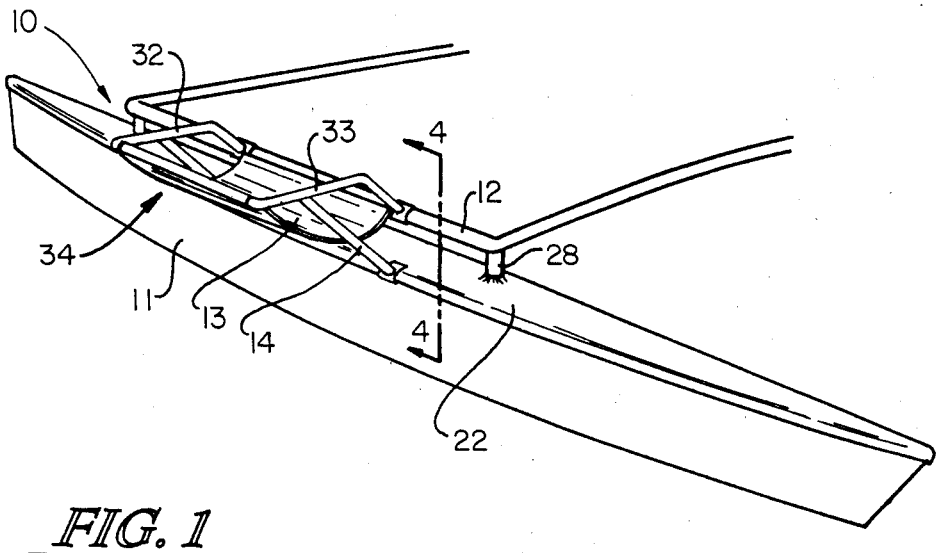
FIG. 1 is a perspective view of one side of a catamaran to which the present invention is attached, showing the basic structure and layout of the boat and the trap seat in position.

FIG. 1 of the drawings shows the portion of a catamaran 10 upon which trap seat 34 is installed. The catamaran 10 consists of two pontoons, one pontoon 11 of which is shown, connected together by a trampoline support 12, which is attached to pontoon 11 by supports 28. Pontoon 11 includes a splash guard 22 positioned at its top. End supports 32 and 33 of trap seat 34 attach as shown to trampoline support 12, and support rod 14 of trap seat 34 attaches to splash guard 22 as shown.

Figure 2:
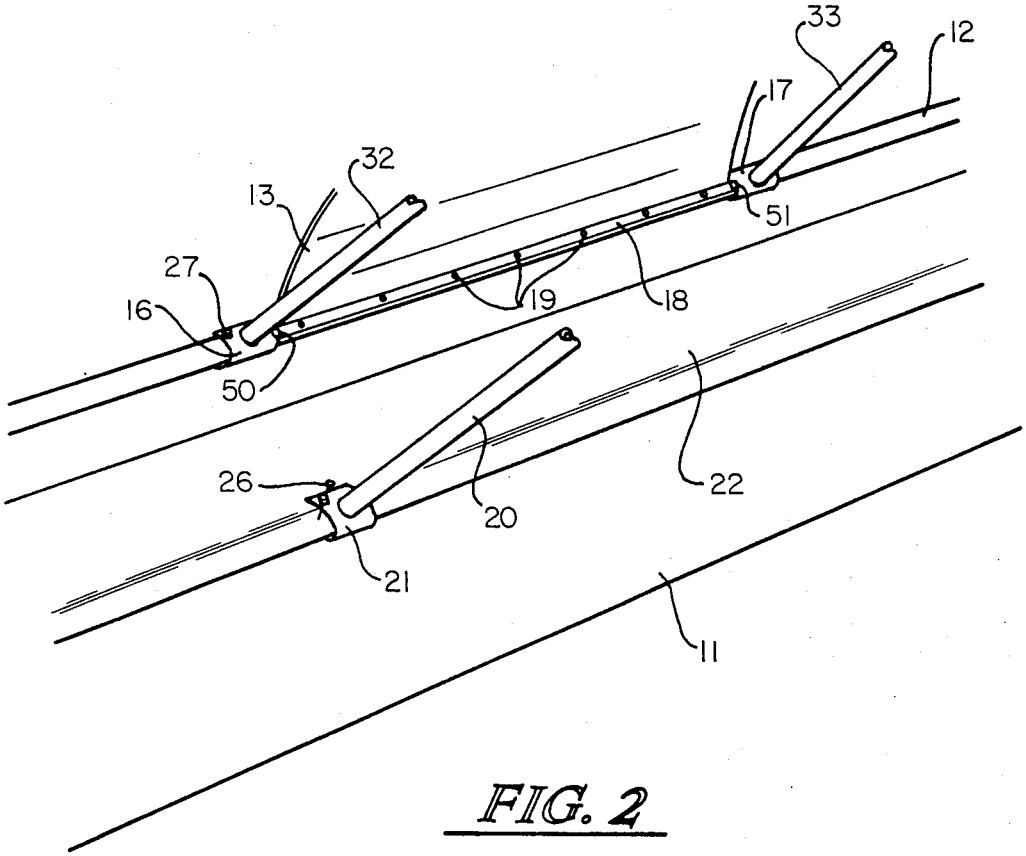
FIG. 2 is a perspective view of part of the seat structure showing how the seat is attached to a catamaran or other sailboat.

This method of attaching trap seat 34 to catamaran 10 is shown in greater detail in FIG. 2. End supports 32 and 33 of trap seat 34 include brackets 16 and 17 which are formed to attach to trampoline support 12 as here shown. The slung seat 13 of trap seat 34 is shown pushed up and out of the way in FIG. 2. It is attached to trampoline support 12 by rod 18 through the use of screws or other fasteners 19. Rod 18 may be attached to brackets 50 and 51 by welding or other appropriate attaching means. Further, support rod 20 attaches to splash guard 22 by means of a pin 26 which holds bracket 21 in position with respect thereto.

Figure 3:
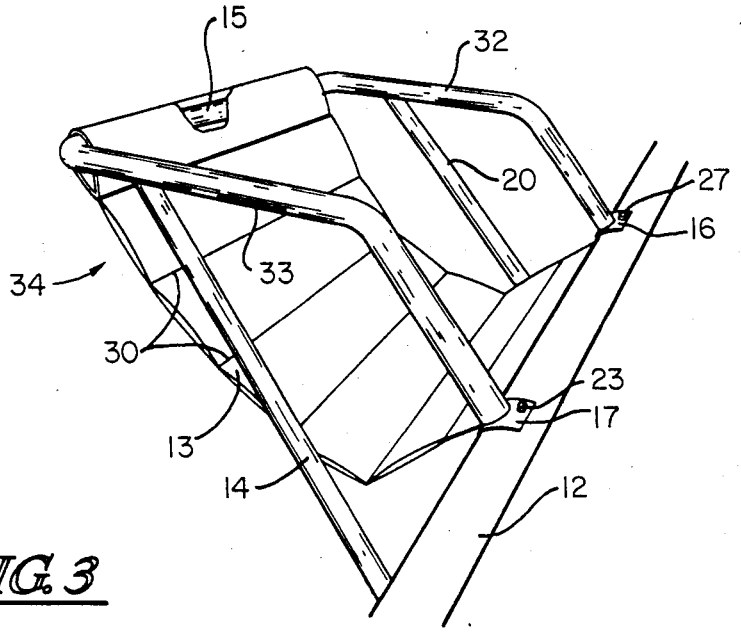
FIG. 3 is a perspective view showing more particularly the construction of the trap seat.

FIG. 3 of the drawings is a perspective view of trap seat 34 more fully illustrating its construction. The frame of trap seat 34 consists of end supports 32 and 33, attached together by back support 15. End supports 32 and 33 and back support 15 are constructed of round metal rod or any other acceptable structural material, and may be constructed of a single piece of rod where appropriate. Support rods 14 and 20 are attached to the frame structure comprising back support 15 and end supports 32 and 33 as shown, by welding or other appropriate fastening means, and extend downward to pontoon 11 of catamaran 10 to give support to the seat frame of trap seat 34 as appropriate. A hammock-type slung seat 13 is provided and is attached to back support 15 as shown and to trampoline support 12 as previously shown in FIG. 2 to provide support which is sufficiently flexible to conform to the contour of an individual's back and body. Trap seat 34 is attached to trampoline support 12 by brackets 16 and 17, which are attached to end supports 32 and 33 respectively. Pins 23 and 27 extend through brackets 17 and 16 respectively into trampoline support 12 to hold them in position thereon.

Figure 4:
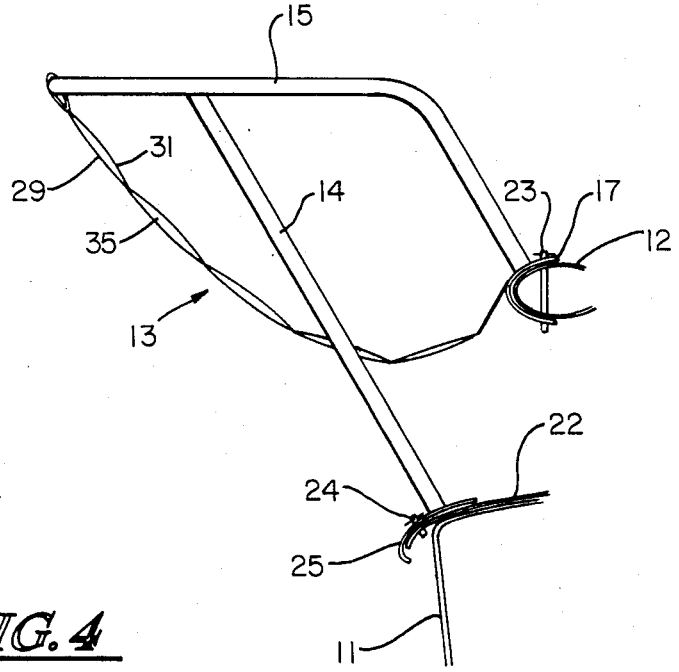
FIG. 4 is an end view taken along lines 4—4 of FIG. 1, showing the structure of the trap seat and how the trap seat attaches to the catamaran of FIG. 1.

FIG. 4 further illustrates the attachment of trap seat 34 to catamaran 10. This view is taken slong lines 4—4 of FIG. 1. As here shown, bracket 17 wraps around trampoline support 12 and is attached thereto by pin 23. The construction of pontoon 11 and splash guard 22 is also shown in greater detail. Bracket 25 wraps around and is contoured to fit splash guard 22, and is attached thereto by pin 24. Slung seat 13 is constructed of canvas, vinyl or other flexible material and, in this particular embodiment, is constructed of one piece of material folded over back support to form two layers 29 and 31, and sewn together along lines 30 as shown in FIG. 3. Any acceptable fill material 35 may be placed between layers 29 and 31 to pad and increase the comfort of slung seat 13.

During use of trap seat 34, an individual's buttocks slide into the lowermost area of slung seat 13, and the rest of slung seat 13 conforms to the back of the individual, leaving the average person's head extending above back support 15. The combination of end supports 32 and 33 and support rods 14 and 20, together with slung seat 13, is sufficient to support the body of a handicapped person so that paraplegics or quadriplegics or other persons who have limited use of arms or legs, once positioned in trap seat 34, are held securely in position and with virtually no possibility of falling out of trap seat 34.

While the foregoing description of the invention has shown a preferred embodiment using specific terms, such description is presented for illustrative purposes only. It is applicant's intention that changes and variations may be made without departure from the spirit or scope of the following claims, and this disclosure is not intended to limit applicant's protection in any way.

I claim:

1. A handicap trap seat for use with sailboats which utilize pontoons and a support frame extending therebetween, comprising:

a seat structure consisting substantially of:

a left end support structure for preventing an individual from sliding out of seat structure;

a right end support structure for preventing an individual from sliding out of said seat structure, and a back support attached to and extending between said left end support structure and said right end support structure;

a first support extension having a top end and a bottom end, said top end of said first support extension being attached to said left end support structure near said back support and extending downward from said left end support structure toward one of said pontoons;

a second support extension having a top end and a bottom end, said top end of said second support extension being attached to said right end support structure near said back support and extending downward from said right end support structure toward one of said pontoons;

first attaching means for attaching said left end support structure to said support frame;

second attaching means for attaching said right end support structure to said support frame;

third attaching means for attaching said bottom end of said first support extension to one of said pontoons;

fourth attaching means for attaching said bottom end of said second support extension to one of said pontoons, and a slung seat which conforms to the contour of the body of an individual seated therein attached to said seat structure and extending substantially between said back support and said first and second attaching means.

2. The invention of claim 1, wherein one end of said slung seat is attached to said seat structure at said back support and wherein the other end is held in position near said support frame by attaching means consisting substantially of a rod attached to said support frame.

3. The invention of claim 1, wherein one end of said slung seat is attached to said back support of said seat structure and wherein the other end is attached to a rod which extends between and is attached to said first and second attaching means.

4. The invention of claim 1, wherein one end of said slung seat is attached to said back support of said seat structure and wherein the other end is attached to a rod which extends between and is attached to said left end support structure near said first attaching means and to said right end support structure near said second attaching means.

* * * * *